United States Patent [19]

Sakojiri et al.

[11] Patent Number: 4,981,834

[45] Date of Patent: Jan. 1, 1991

[54] MULTI-COLOR TRANSFER PRINTING MEDIUM

[75] Inventors: Hiromichi Sakojiri; Hiroshi Takahashi; Fumiharu Iwasaki, all of Tokyo, Japan

[73] Assignee: Seiko Instruments Inc., Japan

[21] Appl. No.: 293,182

[22] Filed: Jan. 3, 1989

[30] Foreign Application Priority Data

Mar. 7, 1988 [JP] Japan ..... 63-53202

[51] Int. Cl.[5] ..... B41M 5/22; B03C 1/72

[52] U.S. Cl. ..... 503/204; 430/138; 503/209; 503/215

[58] Field of Search ..... 427/150–152; 428/913, 914; 430/138; 503/215, 204, 226, 209

[56] References Cited

U.S. PATENT DOCUMENTS

| | | | |
|---|---|---|---|
| 3,301,439 | 1/1967 | Kosar et al. | 222/52 |
| 4,501,809 | 2/1985 | Hiraishi et al. | 430/138 |
| 4,529,992 | 7/1985 | Ishida et al. | 346/204 |
| 4,576,891 | 3/1986 | Adair et al. | 430/138 |
| 4,644,376 | 2/1987 | Usami et al. | 346/215 |
| 4,758,495 | 7/1988 | Yamaguchi et al. | 430/138 |
| 4,760,048 | 7/1988 | Kurihara et al. | 503/204 |

*Primary Examiner*—Bruce H. Hess

*Attorney, Agent, or Firm*—Bruce L. Adams; Van C. Wilks

[57] ABSTRACT

A multi-color transfer printing medium is comprised of at least two different kinds of microcapsules having a porous membrane and disposed on a substrate. Each kind of microcapsules contains a different electron-donating chromogenic material effective to produce a different color tone, and a different light-absorbing material effective to absorb a light of different wavelength. In use, the multi-color transfer printing medium is superposed with a color developing sheet coated with electron-accepting material, and is irradiated with lights of different wavelengths to transfer-print color image on the developing sheet to thereby obtain the multi-color image with a simple process at high speed.

8 Claims, 1 Drawing Sheet

MULTI-COLOR TRANSFER PRINTING MEDIUM

BACKGROUND OF THE INVENTION

1. Field of the Invention

The present invention relates to a recording material or printing medium for recording or printing images by utilizing radiation or light energy, and more specifically relates to a multi-color transfer printing medium for printing multi-color images by utilizing a plurality of lights having different wavelengths.

2. Prior Art

Multi-color images have been previously produced by record producing systems such as electron photography, electrostatic record producing, current application record producing, heat-sensitive record producing, and ink jet record producing. The ink jet method involves a problem of clotting and is not sufficiently reliable, while the other record producing methods require many complicated steps for recording or reproducing the three primary colors repeatedly from a CRT.

As described above, the conventional recording methods suffer from clotting and may require the repeated recording of three primary color video signals. Therefore, there are drawbacks such as mis-matching of color tones tends to occur, the recording can not be carried out at high speed, and the recording device requires a complicated mechanism.

SUMMARY OF THE INVENTION

Consequently, in order to solve the above-noted drawbacks of the prior art, an object of the present invention is to provide a multi-color transfer printing medium effective to reproduce a multi-color image with a simple process at high speed by utilizing a plurality of lights having different wavelengths.

In order to solve the above-mentioned problems, according to the present invention, the multi-color transfer printing medium is comprised of at least two different kinds of microcapsules having a porous membrane, and being disposed on a substrate. Each kind of the microcapsules contains a different electron-donating color former or chromogenic material effective to produce a different color tone, and a different light-absorbing material effective to selectively absorb electromagnetic light radiation of a different wavelength to generate heat energy to release the electron-donating color former from the microcapsules. In use, the transfer-printing medium is superposed on a color developing sheet coated with an electron-accepting material, and is irradiated with electromagnetic radiation of different wavelengths to selectively release the different color formers to enable the same to contact and react with the electron-accepting material to thereby develop a multi-color image on the developing sheet with a simple process at high speed.

DETAILED DESCRIPTION OF THE INVENTION

Figure 1:
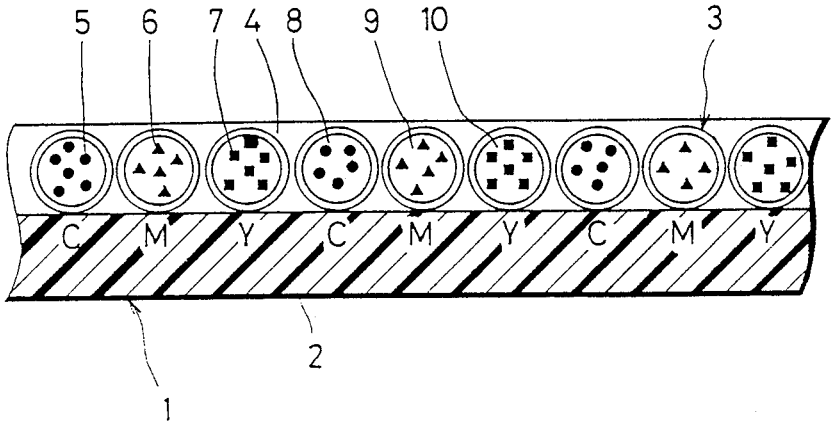
FIG. 1 shows a cross-sectional structure of the inventive multi-color transfer printing medium.

Hereinafter, the present invention will be explained in conjunction with the drawings. FIG. 1 shows a cross section structure of the inventive multi-color transfer printing medium. Three kinds of microcapsules 3 having a porous membrane are uniformly mixed with one another and coated on a substrate 2. The first kind of microcapsules contains an electron-donating chromogenic material 8 effective to produce the cyan color tone and a light-absorbing material 5 effective to selectively absorb a light radiation of wavelength $\lambda_1$. The second kind of microcapsules contains an electron-donating chromogenic material 9 effective to produce the magenta color tone and a light-absorbing material 6 effective to selectively absorb light radiation of wavelength $\lambda_2$. The third kind of micro-capsules contains an electron-donating chromogenic material 10 effective to produce the yellow color tone and a light-absorbing material 7 effective to selectively absorb light radiation of wavelength $\lambda_3$.

Figure 2:
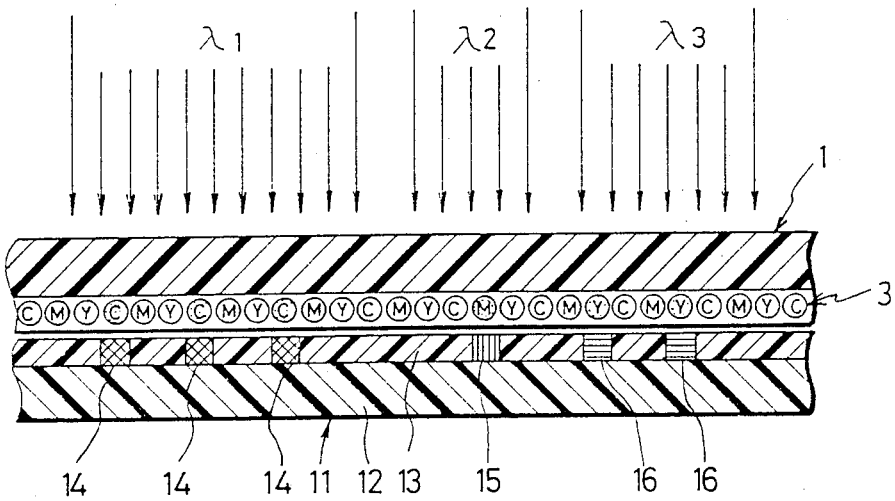
FIG. 2 shows a shematic view illustrating a process of multi-color image reproduction using the multi-color transfer printing medium of FIG. 1.

FIG. 2 shows a process of multi-color transfer printing by utilizing the printing medium of FIG. 1. The printing medium 1 is superposed on a color developing sheet 11 coated with an electron-accepting material 13. The printing medium 1 is irradiated with three lights of wavelength $\lambda_1$, $\lambda_2$ and $\lambda_3$ in response to video signals from a CRT, which represents the image of the three primary color tones. These lights are selectively absorbed by the corresponding microcapsules 3 to release the leuco dyes of electron-donating color formers 8, 9 and 10. These dyes contact and react with the electron-accepting material 13 to develop locally the cyan color tone 14, magenda color tone 15, and yellow color tone 16 to thereby reproduce a transferred multi-color image on the developing sheet 11. As methods for producing the microcapsules used in the present invention, there can be employed known micro-encapsulation and surface modification processes, for example, a coacervation method; an interfacial polymerization method; an in situ method by monomer polymerization; spray drying; and an inorganic wall micro-encapsulation. In particular, interface polymerization, in situ polymerization, etc. are preferred as methods for forming the porous membrane.

Examples of substances which may be employed to make the microcapsules used in the present invention include polyamides, polyesters, polyureas, polyurethanes, urea-formaldehyde resins, melamine resins etc.

Examples of the light-absorbing materials which may be used in the present invention include organic compounds such as anthraquinone compounds, polymethine compounds, cyanine compounds, aminium compounds and diimmonium compounds, and inorganic compounds such as zinc silicate, magnesium silicate, barium sulphate and barium carbonate.

The electron-donating chromogenic materials which can be employed in the present invention can be fluorane derivatives, triphenilmethane derivatives, phenothiazine derivatives, auramine derivatives, spiropyrane derivatives etc. and specific examples include crystal violet lactone, 3.3-bis-(p-dimethylaminophenyl) phthalide, 3.3-bis(p-dimethylaminophenyl)-6-aminophthalide, 3.3-bis(p-dimethylamino-phenyl)-6-nitrophthalide, 3.3-bis(p-dimethylaminophenyl)-6-chlorophthalide, 3-dimethylamino-6-methoxyfluorane, 3-dimethylamino-5.7-dimenthylfluorane, 3-dimethylamino-5.7-dimethylfluorane, 3-diethylamino-7-methylfluorane, 3.6-bis-$\beta$-methoxy-ethoxyfluorane, 3.6-bis-β-cyanoethoxyfluorane, benzoyl leuco methylene blue, rhodamine B lactam, 3-CP-aminophenylphthalide.

Examples of an organic solvent which can dissolve the electron-donating chromogenic materials employed in the present invention include alkylated naphthalenes, alkylated biphenyls, alkylated terphenyls, chlorinated paraffins, etc.

Examples of the electron-accepting materials or developing materials which can be used in the present invention include phenolic compounds such as α-haphthol, β-naphthol, resorcine, hydroquinone, catechol, pyrogallol, etc., activated clay, organic carboxylic acid metal salts, etc.

The substrates which can be used in the present invention may be transparent plastic films such as polyethylene terephtalate (PET).

The microcapsules used in the present invention are coated on the substrate by means of a binder. Examples of the binder include polyvinyl alcohol, methyl cellulose, carboxymethyl cellulose, styren-butadiene latex, etc.

A light source for producing printing or recording lights utilized in the present invention can be a solid laser such as YAG laser, etc.; a gas laser such as a carbon dioxide laser, etc.; and a semiconductor laser, etc.

Hereinafter the present invention will be described with reference to the examples below, but is not to be deemed to be limited thereto.

EXAMPLE 1

Microcapsules A

To 45 g of diisopropylnaphthalen having dissolved therein 5 g of terephthalic acid dichloride were added 1.4 g of crystal violet lactone so as to dissolve therein. A 1 g of cyanine derivative compound (item number Y-2 produced by NIPPON KAYAKU CO., LID.) is dispersed in the above solution for 24 hours by means of a ball mill. The thus prepared solution was mixed with an aqueous solution of 3% polyvinyl alcohol in 100 g of water and the mixture was emulsified and dispersed with a homogenizer to give a dispersion having a mean particle diameter of 10μ. An aqueous solution of 3 g of diethylene triamine and 3 g of sodium carbonate in 24 g of water was added to the dispersion. The mixture was allowed to stand for 24 hours while stirring to give a capsule solution containing the crystal violet lactone and the cyanin derivative compound as a core substance. Next, microcapsules were collected by filtration to obtain the microcapsules A.

Microcapsules B

To 45 g of diisopropylnaphthalene having dissolved therein 5 g of terephthalic acid dichloride were added 1.4 g of rhodamine B lactam so as to dissolve therein. A 1 g of polymethine derivative compound (item number IR-820 produced by NIPPON KAYAKU CO., LTD.) was dispersed in the above solution for 24 hours by means of a ball mill. The thus prepared solution was mixed with an aqueous solution of 3 g of polyvinyl alcohol in 100 g of water and the mixture was emulsified and dispersed with a homogenizer to give a dispersion having a mean particle diameter of 10 μ. An aqueous solution of 3 g of diethylene triamine and 3 g of sodium carbonate in 24 g of water was added to the dispersion. The mixture was allowed to stand for 24 hours while stirring to give a capsule solution containing the rhodamine B lactam and the polymethine derivative compound as a core material. Next, the microcapsules were collected by filtration to obtain the microcapsule B.

Microcapsules C

To 45 g of diisopropylnaphthalene having dissolved therein 5 g of terephthalic acid dichloride were added 1.4 g of 3-CP-aminophenyl phthalide so as to dissolve therein. A 1 g of diimmonium derivative compound (item number IRG-022 produced by NIPPON KAYAKU CO., LTD.) was dispersed into the above solution for 24 hours by means of a ball mill. The thus prepared solution was mixed with an aqueous solution of 3 g cf polyvinyl alcohol in 100 g of water and the mixture was emulsified and dispersed with a homogenizer to give a dispersion having a mean particle diameter of 10 μ. An aqueous solution of 3 g of diethylene triamine and 3 g of sodium carbonate in 24 g of water was added to the dispersion. The mixture was allowed to stand for 24 hours while stirring to give a capsule solution containing the 3-CP-aminophenyl phthalide and the diimmonium derivative compound as a core material. Next, the microcapsules were collected by filtration to obtain the microcapsules C.

Dispersion

To 100 g of 5% polyvinyl alcohol aqueous solution were added 15 g of bisphenol A, 15 g of $SiO_2$ and 6 g of zinc salicylate. The mixture was dispersed for 24 hours in a ball mill to give a dispersion.

To 20 g of 5% polyvinyl alcohol aqueous solution were added 10 g of the microcapsules A and 10 g of the microcapsules B thus obtained. The mixture was stirred and made into a coating solution. The coating solution was coated onto PET film having a thickness of 10 μ in an amount of 30 g/m$^2$ (dry weight) using a wire bar. The coating solution was then dried to give a multi-color transfer printing medium. On the other hand, the above prepared dispersion was coated onto wood free paper of 50 g/m$^2$ in an amount of 40 g/m$^2$ (dry weight) using a wire bar. The dispersion was then dried to give a color developing sheet.

A record was made on the color developing sheet superposed with the multi-color transfer printing medium using a semiconductor laser having a wavelength of 780 nm to give color images having a clear cyan color tone. Next, a record was made on the color developing sheet using a semiconductor laser having a wavelength of 830 nm to give color images having a clear magenta color tone. The cyan and magenta color images showed no color contamination at all.

Example 2

A multi-color transfer printing medium was obtained in a manner similar to Example 1 except that microcapsules C were used in place of the microcapsules B. A record was made on the color developing sheet superposed with the multi-color transfer printing medium using a semiconductor laser having a wavelength of 780 nm to give color images having a clear cyan color tone. Next, a record was made on the same color developing sheet using a semiconductor laser having a wavelength of 1.3 μ to give color images having a clear yellow color tone. The cyan and yellow color images showed no color contamination at all.

Example 3

A multi-color transfer printing medium was obtained in a manner similar to Example 1 except the microcapsules C were used in place of the microcapsules A. A record was made on the color developing sheet superposed with the multi-color transfer printing medium using a semiconductor laser having a wavelength of 830 nm to give color image having a magenta color tone. Next, a record was made on the same color developing sheet using a semiconductor laser having a wavelength of 1.3 $\mu$ to give color images having a clear yellow color tone. The magenta and yellow color images showed no color contamination at al.

Example 4

To 30 g of 5% polyvinyl alcohol aqueous solution were added 10 g of the microcapsules A, 10 g of the microcapsules B, and 10 g of the microcapsules C described in Example 1. The mixture was stirred and made into a coating solution. The coating solution was coated onto ET film having a thickness of 10 $\mu$ in an amount of 30 g/m$^2$ (dry weight) using a wire bar. The coating solution was then dried to give a multi-color transfer printing medium. On the other hand, the dispersion was coated onto 50 g/m$^2$ of wood free paper in an amount of 40 g/m$^2$ (dry weight) using a wire bar. The coating was then dried to give a color developing sheet.

A record was made on the color developing sheet superposed with the multi-color transfer printing medium using a semiconductor having different wavelengths of 780 nm, 830 nm and 1.3 $\mu$ to give color images having clear cyan, magenta and yellow color tones. The cyan, magenta and yellow color images showed no color contamination at all.

As described above, according to the present invention, the multi-color transfer printing medium is comprised of at least two different types of microcapsules having a porous membrane coated on a substrate. Each type of microcapsules contains a different electron-donating chromogenic material effective to produce a different color tone, and contains a different light-absorbing material effective to absorb a different wavelength of light. The transfer printing medium is superposed on a color developing sheet coated with an electron-accepting material and irradiated with different wavelengths of light to transfer-printing a multi-color image on the developing sheet by a simple process at high speed.

What is claimed is:

1. A primary medium for use in developing a color image on a secondary medium coated with a layer of electron-accepting material, comprising: a substrate positionable on the secondary medium; and microcapsules arranged on the substrate in opposed relation to the layer of electron-accepting material, each of the individual microcapsules containing an electron-donating chromogenic material and a light-absorbing material effective to absorb light to generate heat for releasing the electron-donating chromogenic material from the microcapsule by the generated heat so that the released electron-donating chromogenic material comes into contact and reacts with the electron-accepting material to thereby develop a color image on the secondary medium.

2. A primary medium according to claim 1; including at least two different kinds of microcapsules, each kind of microcapsules containing a different light-absorbing material effective to absorb a different wavelength of light, and a different electron-donating chromogenic material reactive to produce a different color tone.

3. A primary medium according to claim 1; wherein the microcapsules have a porous membrane effective to facilitate the release of the electron-donating chromogenic material.

4. A primary medium for use in forming a color image on a secondary medium containing electron-accepting material, the primary medium comprising: a layer of microcapsules; and means supporting the layer of microcapsules to enable the microcapsules to be positioned in opposed relation to the electron-accepting material of the secondary medium; each of the microcapsules containing electron-donating chromogenic material effective when released from the microcapsule to react with the electron-accepting material to produce a given color tone, and a light-absorbing material effective to selectively absorb electromagnetic radiation of a given wavelength to generate sufficient heat energy to effect release of the electron-donating chromogenic material from the microcapsule.

5. A primary medium according to claim 4; wherein the layer of microcapsules includes at least two different kinds of microcapsules, each different kind of microcapsule containing a different electron-donating chromogenic material reactive with the electron-accepting material to produce a different color tone, and a different light-absorbing material effective to selectively absorb electromagnetic radiation of a different wavelength.

6. A primary medium according to claim 5; wherein the layer of microcapsules includes three different kinds of microcapsules.

7. A primary medium according to claim 6; wherein the three different kinds of microcapsules respectively have three different electron-donating chromogenic materials corresponding respectively to color tones of three primary colors.

8. A primary medium according to claim 4; wherein the microcapsules each have a porous membrane.

* * * * *